US012747568B2

(12) United States Patent
Bai

(10) Patent No.: US 12,747,568 B2
(45) Date of Patent: Sep. 29, 2026

(54) WASHING STATION

(71) Applicant: QINGDAO CENTAURY DESIGN CO., LTD., Qingdao (CN)

(72) Inventor: Guifen Bai, Qingdao (CN)

(73) Assignee: QINGDAO CENTAURY DESIGN CO., LTD., Qingdao (CN)

( * ) Notice: Subject to any disclaimer, the term of this patent is extended or adjusted under 35 U.S.C. 154(b) by 0 days.

(21) Appl. No.: 19/284,487

(22) Filed: Jul. 29, 2025

(65) Prior Publication Data

US 2025/0354361 A1 Nov. 20, 2025

Related U.S. Application Data

(63) Continuation of application No. PCT/CN2023/084712, filed on Mar. 29, 2023.

(30) Foreign Application Priority Data

Feb. 17, 2023 (CN) ..... 202320249673.5

(51) Int. Cl.
*E03C 1/14* (2006.01)

(52) U.S. Cl.
CPC ..... *E03C 1/14* (2013.01)

(58) Field of Classification Search
CPC ... A47K 1/02; A47K 1/04; A47K 1/05; A47K 1/10; A47K 1/12; A47K 3/03; A47K 3/06; A47K 3/062; A45D 19/04
See application file for complete search history.

(56) References Cited

U.S. PATENT DOCUMENTS 4,821,347 A * 4/1989 Nash ..... A45D 19/04 4/519
7,730,561 B2 * 6/2010 Kostelyk ..... E03B 11/02 4/625

(Continued)

FOREIGN PATENT DOCUMENTS

CN 206298932 U 7/2017
CN 107386384 A 11/2017
CN 207331894 U 5/2018

(Continued)

OTHER PUBLICATIONS

International Search Report of PCT/CN2023/084712.

*Primary Examiner* — Janie M Loeppke
(74) *Attorney, Agent, or Firm* — J.C. PATENTS

(57) ABSTRACT

The present application relates to a washing station, which comprises a fluid storage container and a wash basin; the wash basin is detachably mounted on a top of the fluid storage container, wherein at least one water outlet is provided on the wash basin, and an interlocking structure is provided on a side wall of the wash basin; a pull rod is provided on the fluid storage container, and a supporting structure is provided on the pull rod. By means of the cooperation between the interlocking structure and the supporting structure, the wash basin can be supported at different heights. The present application enables height adjustment of the wash basin by mounting the detachable wash basin onto the supporting structure, which simplifies the overall structure and effectively addressing the problem of varying height requirements among users of different statures.

13 Claims, 9 Drawing Sheets

(56) References Cited

U.S. PATENT DOCUMENTS

| | | | | |
|---|---|---|---|---|
| 2004/0148697 | A1 | 8/2004 | Patterson | |
| 2010/0162479 | A1 * | 7/2010 | Tai | A45D 19/04 4/516 |

FOREIGN PATENT DOCUMENTS

| | | | | |
|---|---|---|---|---|
| CN | 110974071 | A | 4/2020 | |
| CN | 212336192 | U | 1/2021 | |
| CN | 213173986 | U | 5/2021 | |
| CN | 2137 87090 | U | 7/2021 | |
| CN | 214272267 | U | 9/2021 | |
| CN | 216007141 | U | 3/2022 | |
| CN | 217923905 | U | 11/2022 | |
| JP | H06343570 | A | 12/1994 | |
| KR | 102253589 | B1 * | 5/2021 | A45D 19/10 |

* cited by examiner

WASHING STATION

CROSS-REFERENCE TO RELATED APPLICATIONS

This application is a continuation of the international application PCT/CN2023/084712, filed on Mar. 29, 2023, which claims priority to the Chinese Patent Application 202320249673.5 filed to the CNIPA on Feb. 17, 2023 and entitled "WASHING STATION", the disclosure of the above identified applications is hereby incorporated by reference in its entirety.

TECHNICAL FIELD

The present application belongs to the technical field of sanitary ware, and in particular to a washing station.

BACKGROUND ART

During outdoor activities, there is often a need for washing. However, it is very troublesome, time-consuming and laborious to find a place with a fixed washing station outdoors, and cannot quickly meet people's washing needs.

The Chinese patent with publication number CN216007141U discloses a mobile wash basin assembly, which includes a clean water tank and a wash basin. The clean water tank is provided with a water inlet and at least one clean water outlet. The wash basin is detachably mounted on the side of the clean water tank, including a sink basin and a waste water tank that are arranged vertically and in fluid communication with each other, a faucet arranged on the sink basin, and a foot-operated water pump arranged at the bottom of the wash basin. A water inlet of the foot-operated water pump is in fluid communication with the clean water outlet, and a water outlet of the foot-operated water pump is in fluid communication with the faucet. The detachable combination of the clean water tank and the wash basin allows for free combination according to actual needs. When disassembled into individual components, they are easy to transport and can be moved to any desired place, making it suitable for temporary use scenarios.

However, a fixed-height washing station cannot meet the needs of users with different statures. Due to height limitations, shorter individuals often find it inconvenient to use an overly tall washing station for washing operations. Conversely, taller individuals may suffer from aggravated lumbar muscle strain when bending over a washing station that is too low for a long time.

SUMMARY

In view of the shortcomings of the related art, the present application provides a washing station, comprising:

a fluid storage container, wherein a pull rod is provided on the fluid storage container, and a supporting structure is provided on the pull rod;

a wash basin, detachably mounted on a top of the fluid storage container, wherein at least one water outlet is provided on the wash basin, and an interlocking structure is provided on a side wall of the wash basin;

wherein the supporting structure is configured to engage with the interlocking structure to support the wash basin at different height positions.

In some embodiments, the pull rod comprises a grip portion and support portions extending in a height direction from both ends of the grip portion, wherein at least a portion of each of the support portions serves as the supporting structure, the supporting structure comprises a wave-shaped wavy section; the interlocking structure comprises a plurality of protrusions provided on the side wall of the wash basin, wherein a contour of the plurality of the protrusions is complementary in shape to the wavy section and configured to lockingly engage with the wavy section to provide positional constraint.

In some embodiments, the interlocking structure is connected to the wash basin and two wing-shaped portions extending toward opposite sides are formed at an end of the interlocking structure, an interlocking slot is formed between each of the wing-shaped portions and the side wall of the wash basin, and the protrusions are formed at a closed end of each of the interlocking slots.

In some embodiments, the pull rod further comprises two connecting portions located on a side opposite to the grip portion, and the two connecting portions extend toward each other from ends of respective support portions; mounting slots are provided on an outer wall of the fluid storage container, the connecting portions are rotatably inserted in respective mounting slots, and the pull rod is configured to rotate about the connecting portions as a rotation axis.

In some embodiments, two receiving grooves are formed longitudinally on the outer wall of the fluid storage container, and the two receiving grooves are arranged on a same outer wall surface as the pull rod and match shapes of respective support portions; each of the mounting slots is connected with a corresponding receiving groove and is positioned near an upper part of the receiving groove, and each of the mounting slots divides the corresponding receiving groove into a first receiving groove located at an upper part and a second receiving groove located at a lower part; wherein when the pull rod is rotated upward, the support portions are received in respective first receiving grooves, and when the pull rod is rotated downward, the support portions are received in respective second receiving grooves.

In some embodiments, two positioning holes and a positioning groove are provided at a bottom of the wash basin, with the two positioning holes respectively located on both sides of the positioning groove; two positioning bosses and a positioning frame are provided at a top of the fluid storage container; the two positioning bosses are configured to engage with respective positioning holes for positioning, and the positioning frame is configured to engage with and be snap-fitted into the positioning groove, so as to mount the wash basin on the top of the fluid storage container.

In some embodiments, a moving device is provided at a bottom of the fluid storage container.

In some embodiments, the washing station further comprises a foot-operated mechanism configured to supply water to the water outlet, and the foot-operated mechanism comprises:

a connecting pipe, one end of which is in fluid communication with an interior of the fluid storage container and another end of which is connected to the water outlet;

a foot pump, disposed at a lower part of the fluid storage container and connected to the connecting pipe;

a first one-way valve, disposed in the connecting pipe and located between the fluid storage container and the foot pump, the first one-way valve is configured to allow fluid to flow only from the fluid storage container to the foot pump; and a second one-way valve, disposed in the connecting pipe and located between the foot pump and the water outlet, the second one-way valve is configured to allow fluid to flow only from the foot pump to the water outlet.

In some embodiments, an outer wall surface of the fluid storage container facing a user when in use is defined as a front surface, while an outer wall surface opposite to the user is defined as a rear surface; a first recess is recessed inwardly at a lower part of the front surface, and the foot pump is arranged at a bottom of the first recess; a second recess is formed longitudinally on the rear surface, and a water supply pipe connecting the connecting pipe to the water outlet is arranged in the second recess.

In some embodiments, the wash basin is a hollow storage container and is provided with an injection port at a top of the wash basin, a top surface of the wash basin is recessed to form a water collection recess, and a drainage outlet penetrating the wash basin is formed at a bottom of the water collection recess.

In some embodiments, a drain pipe is provided at the drainage outlet, one end of the drain pipe is connected to the drainage outlet, and an other end of the drain pipe is bent to discharge water out of the wash basin and bypass the fluid storage container below.

In some embodiments, a bottom surface of the wash basin is inwardly recessed to form a drainage recess, the drainage outlet penetrates through the bottom of the water collection recess and the drainage recess, and the drain pipe is accommodated in the drainage recess.

In some embodiments, a through hole for the water supply pipe to pass through is opened in the wash basin corresponding to the water supply pipe, and a faucet with the water outlet facing the water collection recess is mounted above the through hole.

In some embodiments, a handle groove is provided on each of outer walls of two opposite sides of the wash basin.

Compared with the prior art, the beneficial effects of the present application are as follows.

(1) In at least one embodiment of the present application, the washing station allows height adjustment of the wash basin through the cooperation between the supporting structure and the interlocking structure, thereby meeting the height requirements of users of different statures. The overall structure is simple and easy to adjust.

(2) In at least one embodiment of the present application, the washing station integrates the support function for the wash basin into the pull rod by optimizing its structure, eliminating the need for additional supporting components and thereby simplifying the overall structure and operation.

(3) In at least one embodiment of the present application, the washing station enables adjustable and stable height support of the wash basin through the engagement between the wave-shaped wavy section and the protrusions, allowing the protrusions to be lockingly engaged with the wavy section at different height positions as needed.

(4) In at least one embodiment of the present application, the pull rod is rotatably mounted on the outer wall of the fluid storage container and corresponding receiving grooves are formed on the outer wall of the fluid storage container. When the pull rod is not in use, it can be rotated downward and stored in the receiving grooves to save space.

(5) In at least one embodiment of the present application, the washing station comprises a pedal mechanism that establishes a unidirectional flow channel from the fluid storage container to the water outlet, allowing the user to supply water to the wash basin by simply stepping on the foot pump.

(6) In at least one embodiment of the present application, the washing station is provided with a moving device that cooperates with the pull rod to facilitate transportation and portability, thereby satisfying outdoor washing needs.

BRIEF DESCRIPTION OF THE DRAWINGS

The accompanying drawings described herein are used to provide a further understanding of the present application and constitute a part of the present application. The exemplary embodiments of the present application and their descriptions are used to explain the present application and do not constitute an improper limitation on the present application. In the drawings.

In the drawings.

1, wash basin; 101, water outlet; 102, interlocking structure; 1021, protrusion; 1022, wing-shaped portion; 1023, interlocking slot; 103, positioning hole; 104, positioning groove; 105, injection port; 106, water collection recess; 107, drainage outlet; 108, drain pipe; 109, through hole; 110, faucet; 111, handle groove; 112, drainage recess; 2, fluid storage container; 201, mounting slot; 202, receiving groove; 2021, first receiving groove; 2022, second receiving groove; 203, positioning boss; 204, positioning frame; 205, first recess; 206, second recess; 207, filling port; 3, pull rod; 301, supporting structure; 3011, wavy section; 310, grip portion; 320, support portion; 330, connecting portion; 4, moving device; 5, foot-operated mechanism; 501, connecting pipe; 502, foot pump; 503, first one-way valve; 504, second one-way valve; 505, water supply pipe.

DETAILED DESCRIPTION OF EMBODIMENTS

The technical solutions in the embodiments will be described clearly and completely below with reference to the accompanying drawings. Apparently, embodiments to be described are merely some but not all of the embodiments of the present application. Based on the embodiments of the present application, all other embodiments obtained by those skilled in the art without creative efforts shall fall within the protection scope of the present application.

It should be noted that, in the description of the present application, directional or positional relationships indicated by terms such as "lateral", "longitudinal", "upper", "lower", "front", "rear", "left", "top", "bottom", "inner", and "outer" are based on directional or positional relationships as shown in the accompanying drawings, and are intended solely for the purpose of facilitating and simplifying the descriptions, rather than indicating or implying that the referred apparatus or element has to have a particular orientation or be constructed and operated in a particular orientation, and therefore, such terms should not be construed as limitations on the present application. Terms "first", "second" and "third" are for descriptive purposes only, and cannot be understood as indicating or implying the relative importance or implicitly indicating the number of indicated technical features.

It should be noted that, unless otherwise explicitly specified or limited, the terms "mounted", "connected," and "coupled" as used in the present application shall be interpreted broadly. For example, the connection may be a fixed connection, a detachable connection, or an integrally formed connection; it may be a direct connection or an indirect connection via an intermediate medium; it may also refer to inter communication between two elements. Those skilled in the art will understand the specific meaning of the above terms in the context of the present application based on the particular circumstances.

Figure 1:
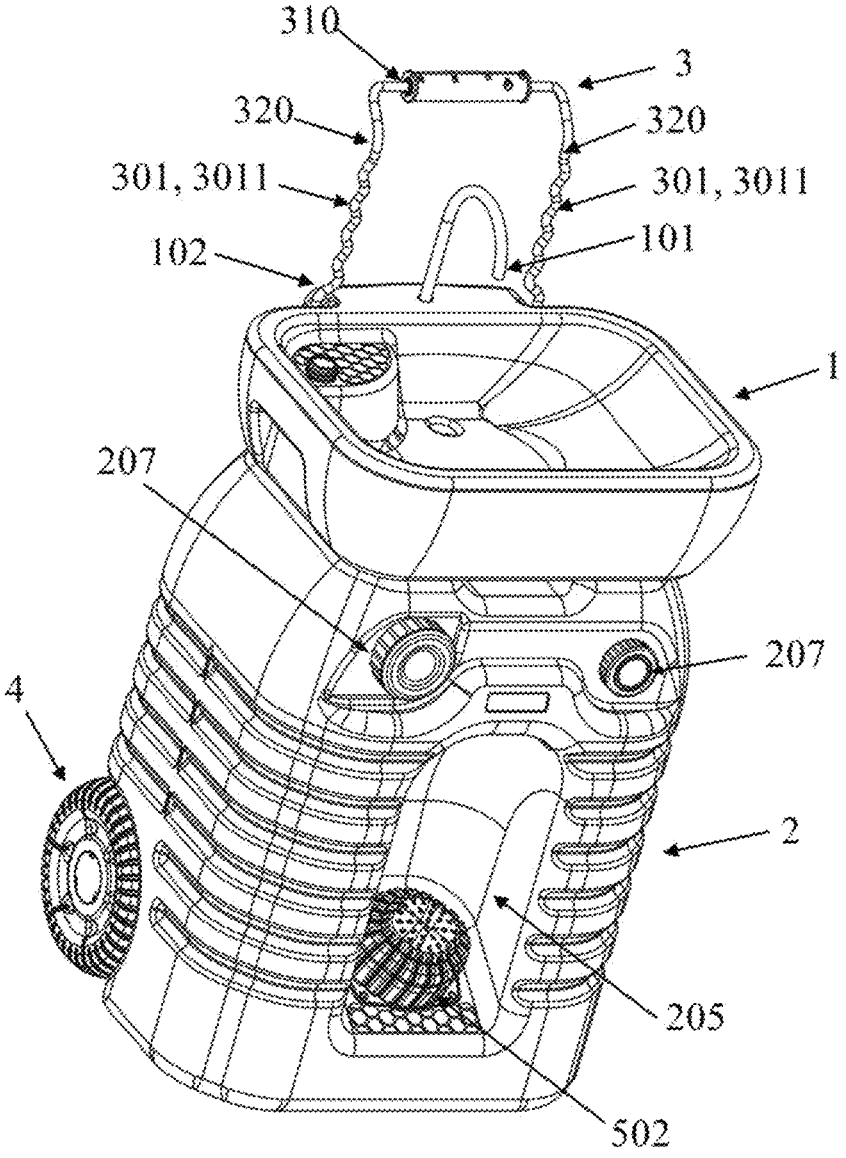
FIG. 1 is a first perspective view of an initial state of a washing station provided by an embodiment of the present application.

As shown in FIG. 1, an embodiment of the present application provides a washing station, which comprises a wash basin 1 and a fluid storage container 2, wherein the wash basin 1 is detachably mounted on a top of the fluid storage container 2, and at least one water outlet 101 is provided on the wash basin 1, through which water can flow out to allow a user to perform washing operations.

Figure 2:
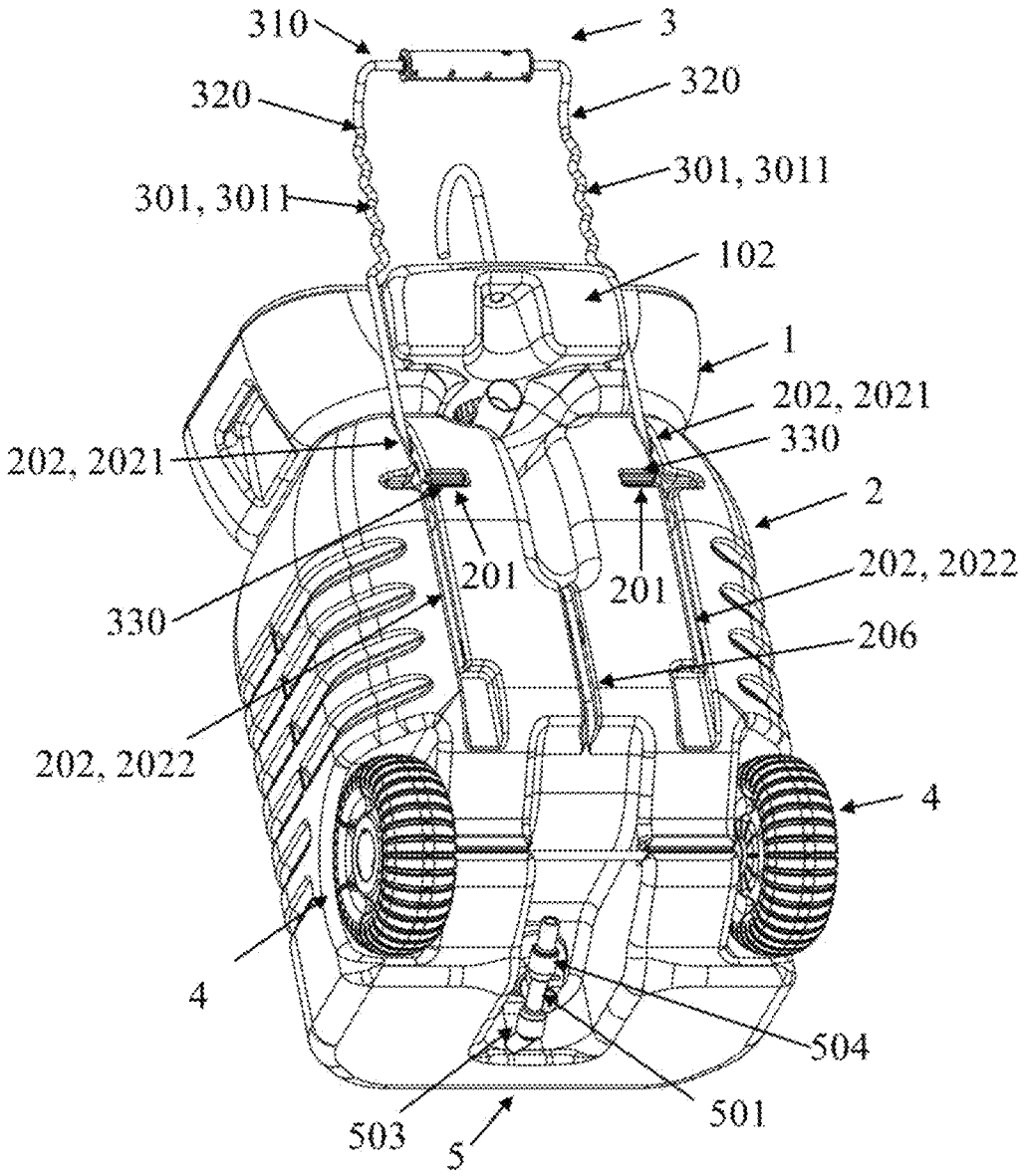
FIG. 2 is a second perspective view of the initial state of the washing station provided by an embodiment of the present application.
Figure 3:
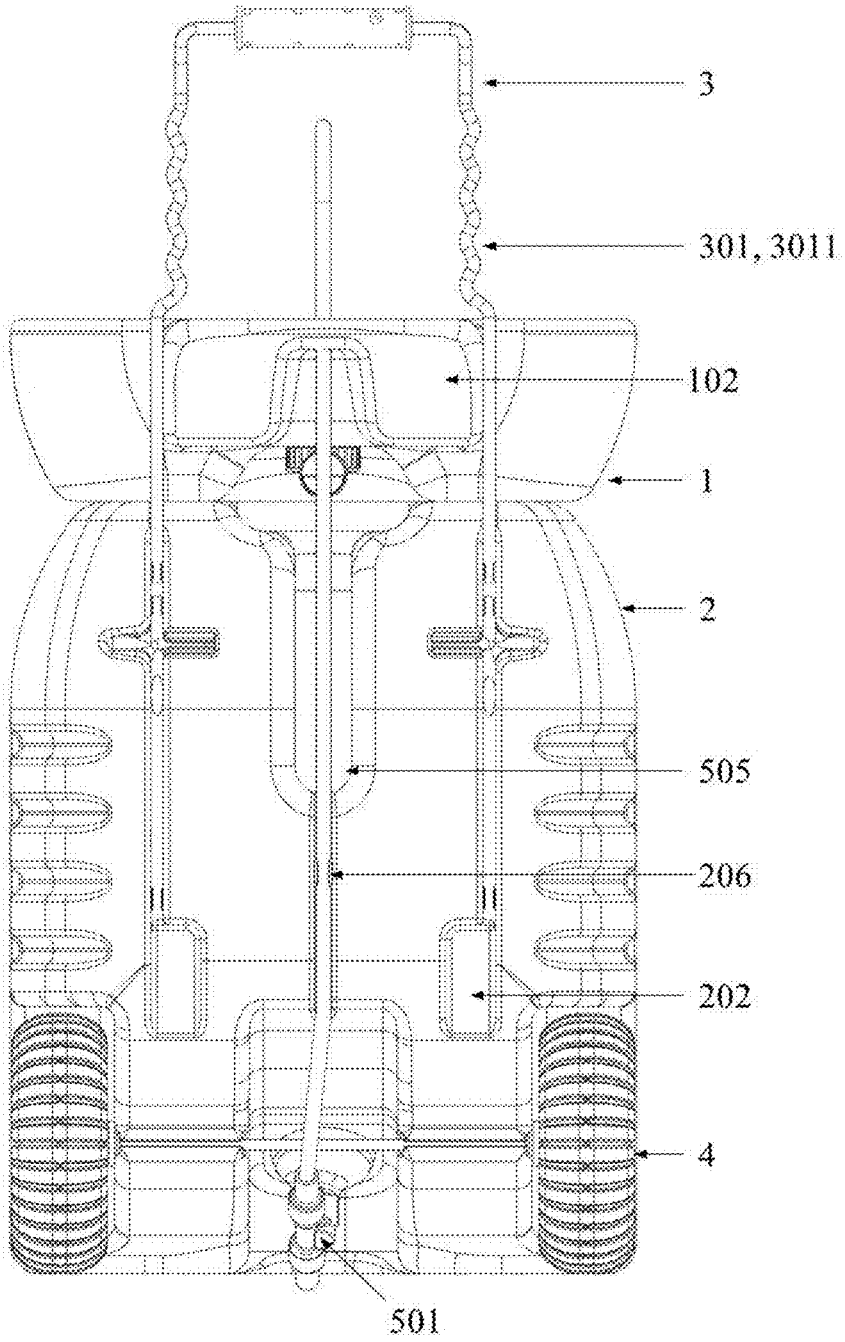
FIG. 3 is a rear view of the washing station provided by an embodiment of the present application.

As shown in FIGS. 1-3, a pull rod 3 is provided on the fluid storage container 2 to facilitate movement of the washing station. A supporting structure 301 is provided on the pull rod 3, and an interlocking structure 102 is provided on a side wall of the wash basin 1, wherein the supporting structure 301 is configured to engage with the interlocking structure 102 to support the wash basin 1 at different heights, so as to adjust the height of the wash basin 1 and enable the washing station to be applicable to users with different statures.

In the aforementioned embodiment of the present application, by adjusting the structure of the pull rod, the height adjustment and support of the wash basin are realized. There is no need for additionally arranged supporting components, and the structure is simple with easy operation.

In some embodiments, the pull rod 3 comprises a grip portion 310 and support portions 320 extending in a height direction from both ends of the grip portion 310, and at least a portion of each of the support portions 320 serves as the supporting structure 301. A rotatable handle is provided on the grip portion 310 to facilitate user operation.

Figure 4:
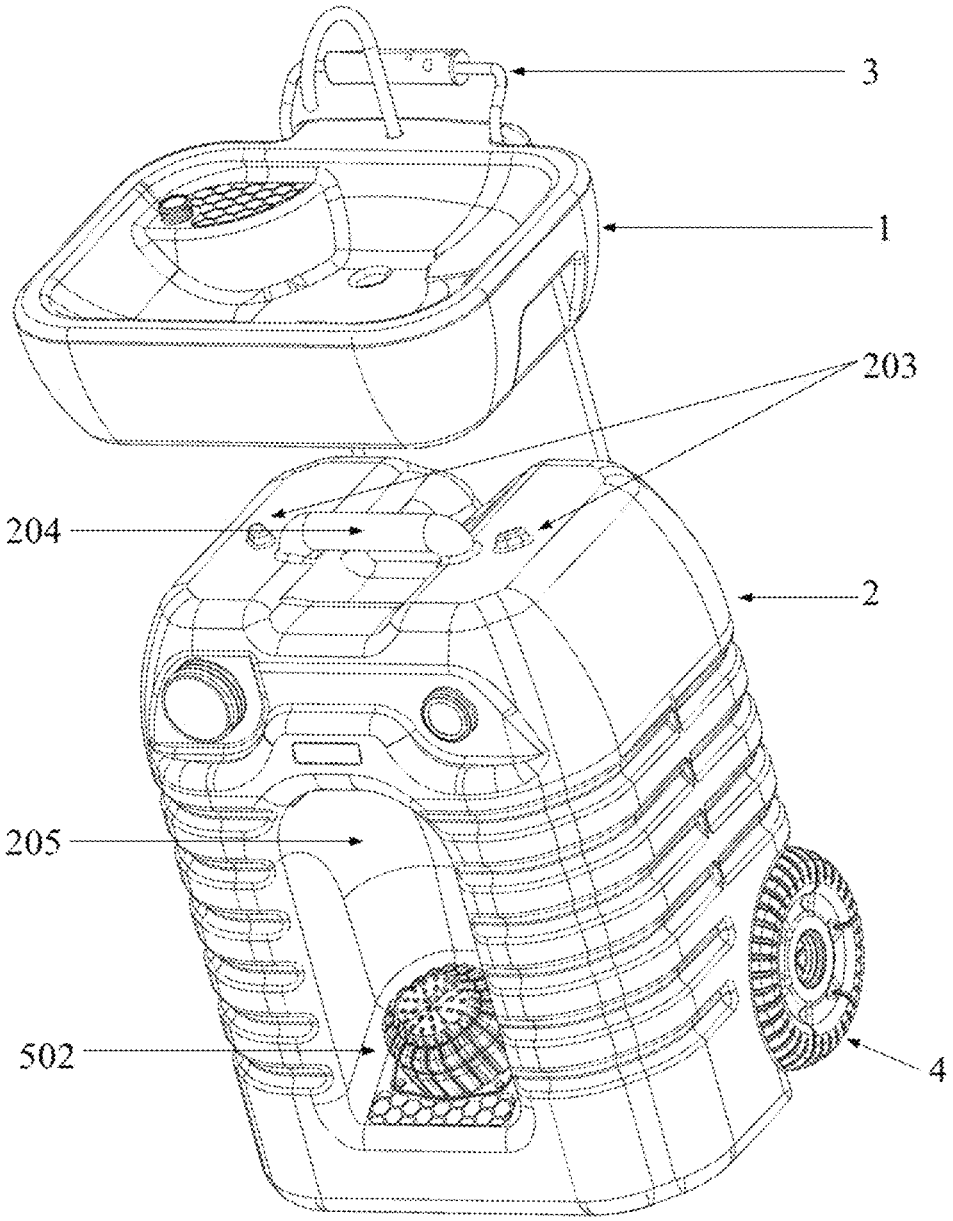
FIG. 4 is a perspective view of a wash basin in a supported state in an embodiment of the present application.
Figure 5:
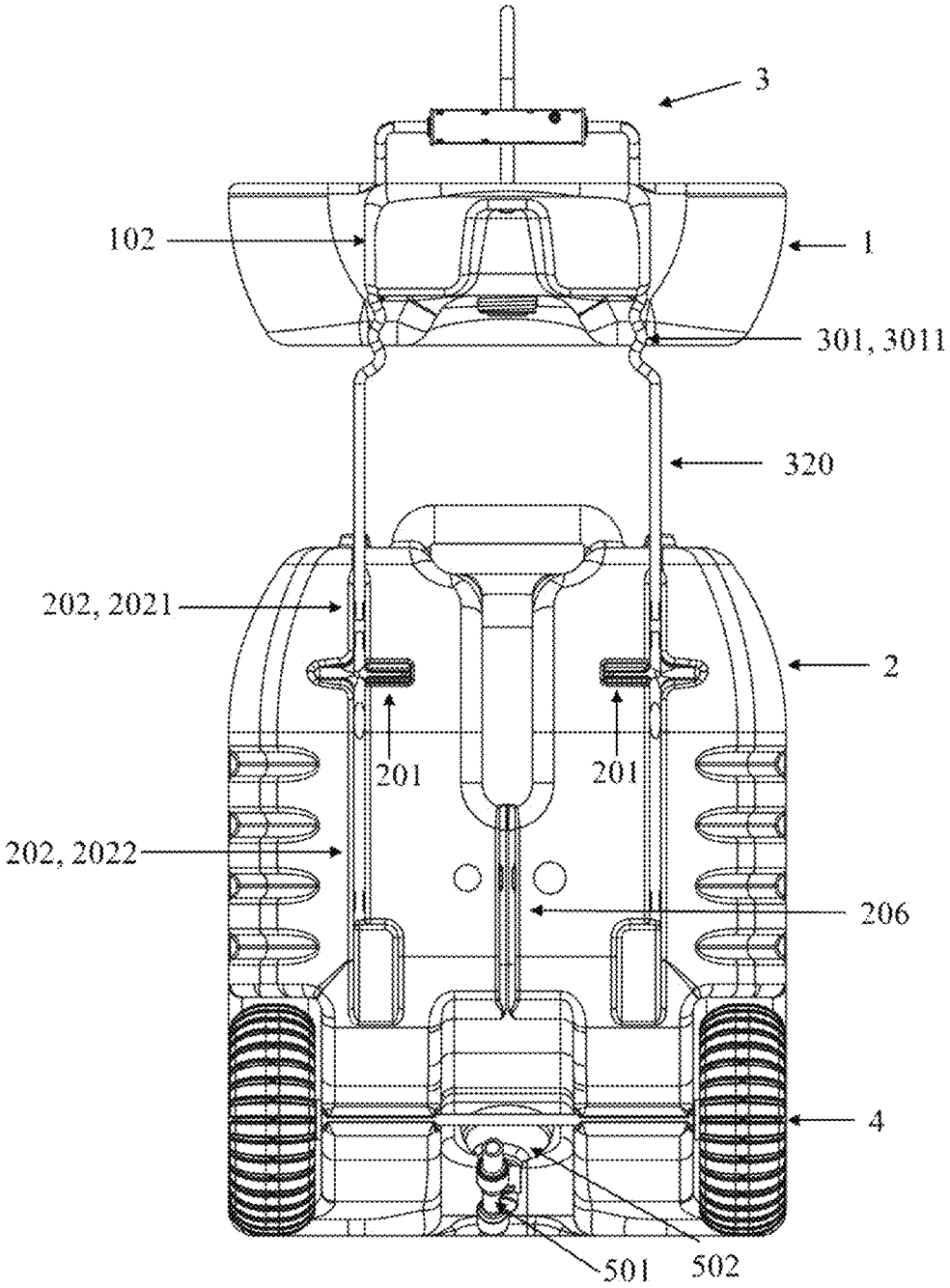
FIG. 5 is a rear view of the wash basin in the supported state in an embodiment of the present application.
Figure 6:
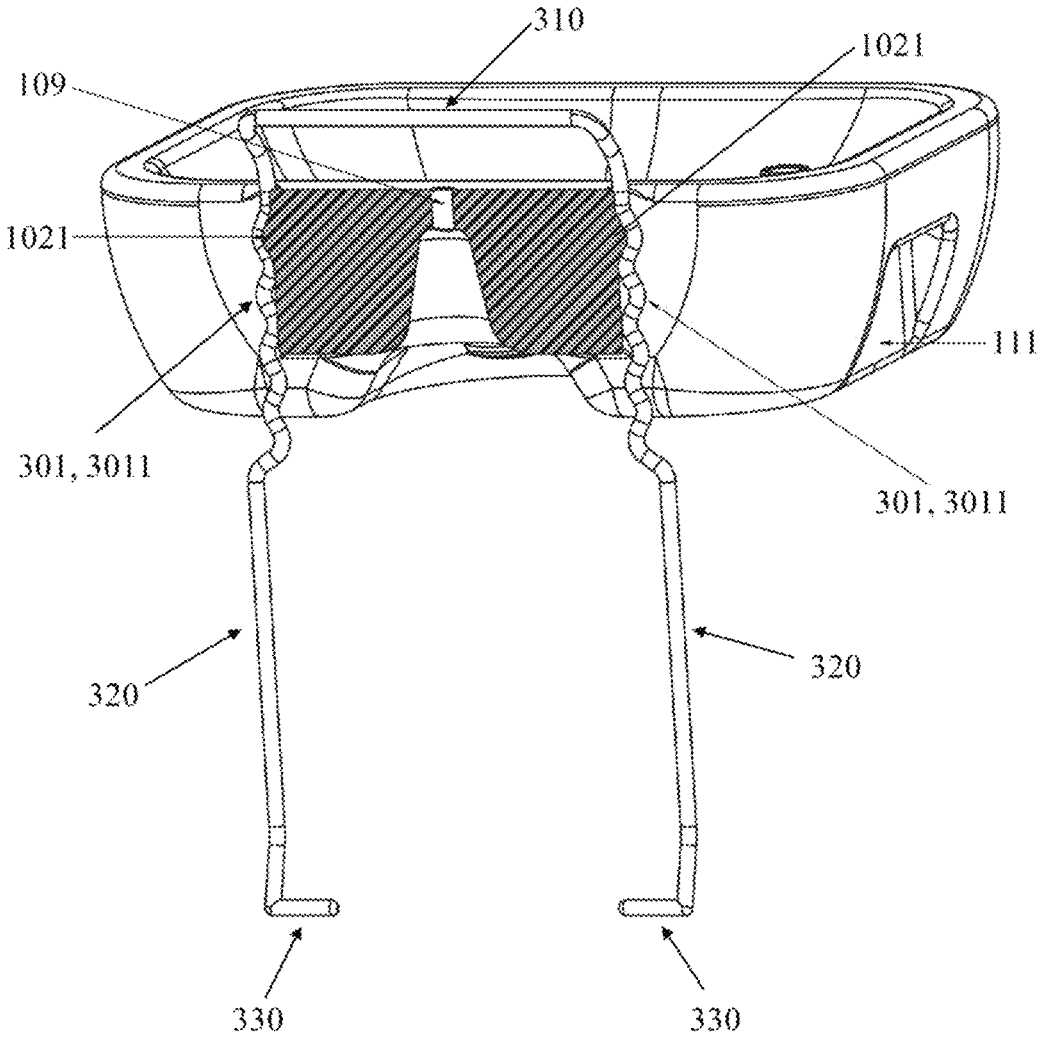
FIG. 6 is a schematic sectional view showing the engagement between an interlocking structure and a supporting structure in an embodiment of the present application.

As an implementation of the supporting structure 301, the supporting structure 301 is configured as a wave-shaped wavy section 3011, and the interlocking structure 102 comprises a plurality of protrusions 1021 (as shown in FIG. 6) provided on the side wall of the wash basin 1. The contour of the plurality of the protrusions 1021 is complementary in shape to the wavy section 3011. The wavy section 3011 has a certain length, and the protrusions 1021 configured to lockingly engage with the wavy section 3011 at different heights to provide positional constraint, thereby securely supporting the wash basin 1 at different heights. As shown in FIG. 4 and FIG. 5, the wash basin 1 is supported at a certain height by the supporting structure 301.

Figure 9:
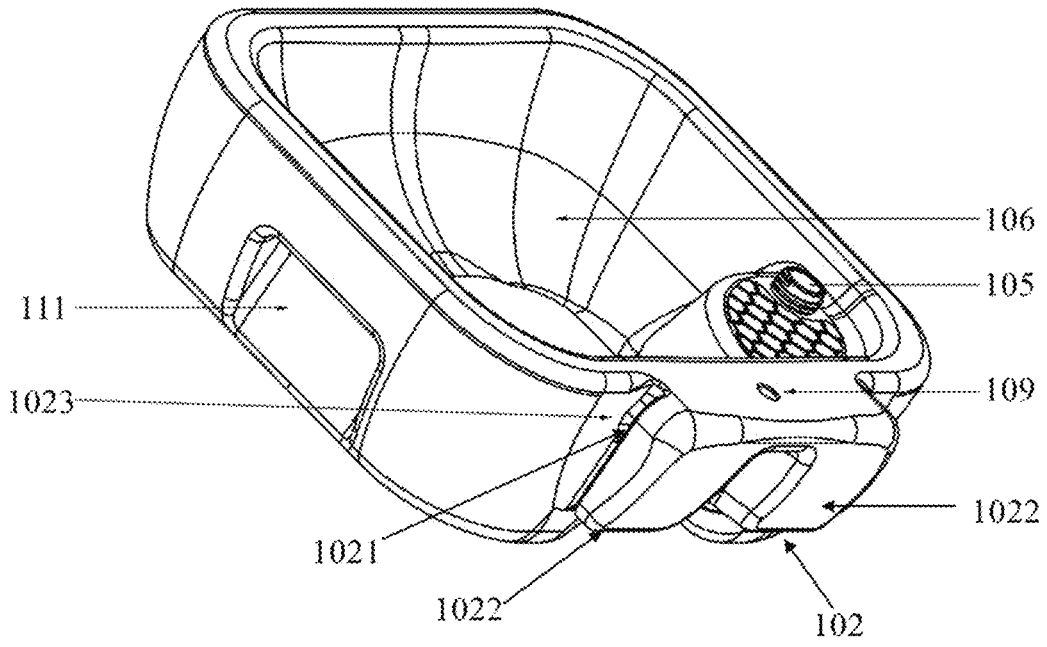
FIG. 9 is a second structural schematic diagram of the wash basin in an embodiment of the present application.

As an implementation of the interlocking structure, in some embodiments, as shown in FIG. 9, the interlocking structure 102 is connected to the wash basin 1. Specifically, the interlocking structure 102 is disposed on a back side of the wash basin 1, and an end of the interlocking structure 102 extending toward opposite sides to form two wing-shaped portions 1022, and an interlocking slot 1023 is formed between each of the wing-shaped portions 1022 and the side wall of the wash basin 1 (specifically the back side of the wash basin 1), and the protrusions 1021 are formed at a closed end of the interlocking slot 1023.

As shown in FIGS. 4 to 6, the support portions 320 located on both sides of the pull rod 3 pass through the interlocking slots 1023 and the wavy sections 3011 thereon are engaged and retained at a certain height by the protrusions 1021. The lateral displacement of the support portions 320 is restricted by the side wall of the wash basin 1 and the wing-shaped portions 1022, while the longitudinal displacement of the support portions 320 is restricted by the protrusions 1021, thereby achieving a locked connection between the interlocking structure 102 and the supporting structure 301.

It can be understood that, in order to ensure that the supporting structure 301 is firmly locked by the interlocking structure 102 in the height direction, a distance between the two wavy sections 3011 on the two supporting portions 320 is equal to or slightly greater than a distance between closed ends of the interlocking slots 1023 on both sides of the interlocking structure 102. This allows the wavy sections 3011 to be tightly engaged with the protrusions 1021, thereby achieving stable clamping.

Figure 11:
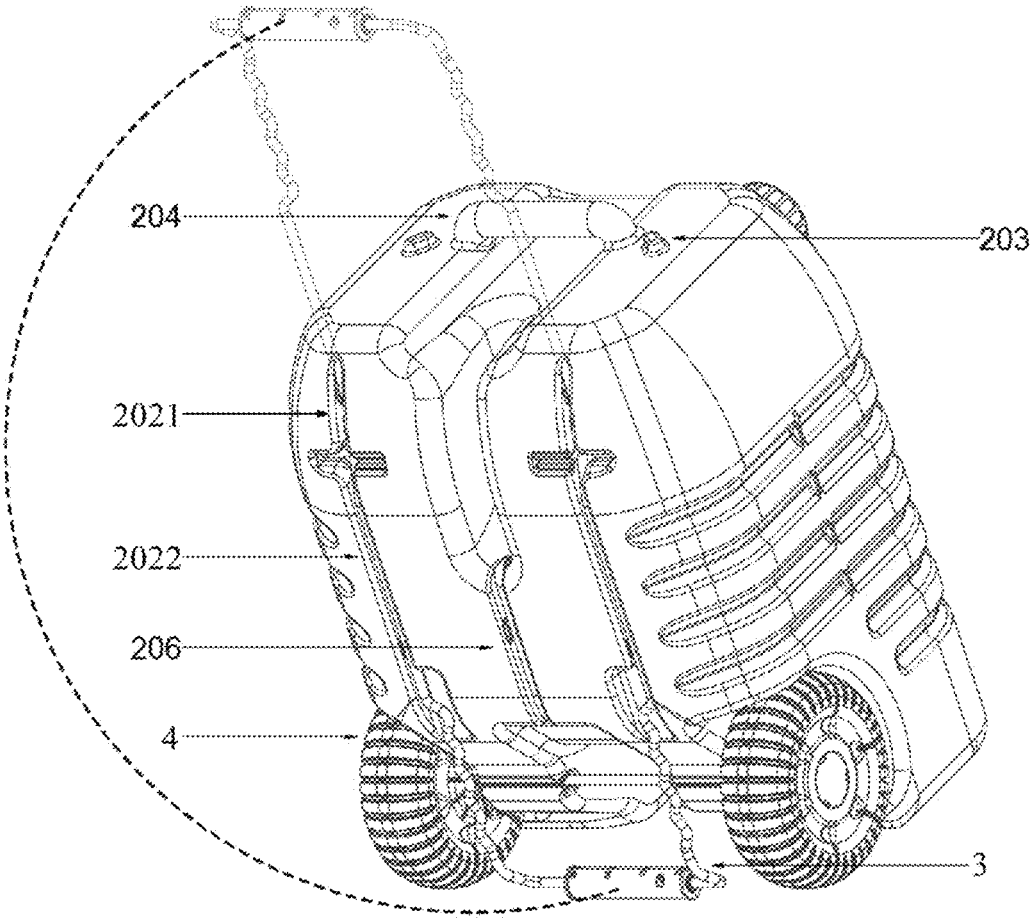
FIG. 11 is a schematic diagram showing the motion path of a pull rod relative to the fluid storage container in an embodiment of the present application.

In some embodiments, as shown in FIG. 5 and FIG. 6, the pull rod 3 further comprises two connecting portions 330 located on a side opposite to the grip portion 310, and the two connecting portions 330 extend toward each other from ends of respective support portion 320. Mounting slots 201 are provided on an outer wall of the fluid storage container and the connecting portions 330 are rotatably inserted in the mounting slots 201, and the pull rod 3 is configured to rotate about the connecting portions 330 as a rotation axis. As shown in FIG. 11, when it is necessary to support and adjust the height of the wash basin above the fluid storage container 2, or to move the washing station by using the pull rod, the pull rod 3 is rotated upward for positioning; when the pull rod 3 is not in use, the pull rod 3 is rotated downward to save space.

In some embodiments, as shown in FIG. 5, two receiving grooves 202 are formed longitudinally on the outer wall of the fluid storage container 2 from top to bottom. The two receiving grooves 202 are arranged on a same outer wall surface as the pull rod 3 (specifically, the back side surface of the fluid storage container 2) and correspond to the two support portions 320. Each of the mounting slots 201 is connected with a corresponding receiving groove 202 and is positioned near an upper part of the receiving groove 202, Each of the mounting slot 201 divides the corresponding receiving groove 202 into a first receiving groove 2021 located at an upper part and a second receiving groove 2022 located at an lower part. When the pull rod 3 is rotated upward, the support portions 320 are received in respective first receiving grooves 2021; when the pull rod 3 is rotated downward, the support portions 320 are received in respective second receiving grooves 2022. Relatively protruding latch points are respectively provided at openings of the first receiving groove 2021 and the second receiving groove 2022 to retain the support portion 320 in the first receiving groove 2021 or the second receiving groove 2022.

In some embodiments, a moving device 4 is provided at a bottom of the fluid storage container 2. The moving device 4 includes but is not limited to a wheel assembly, and the moving device 4 is configured to cooperate with the pull rod 3 provided on the fluid storage container 2 to enable movement of the fluid storage container 2, facilitating convenient transportation of the fluid storage container 2 and the washing station.

Figure 7:
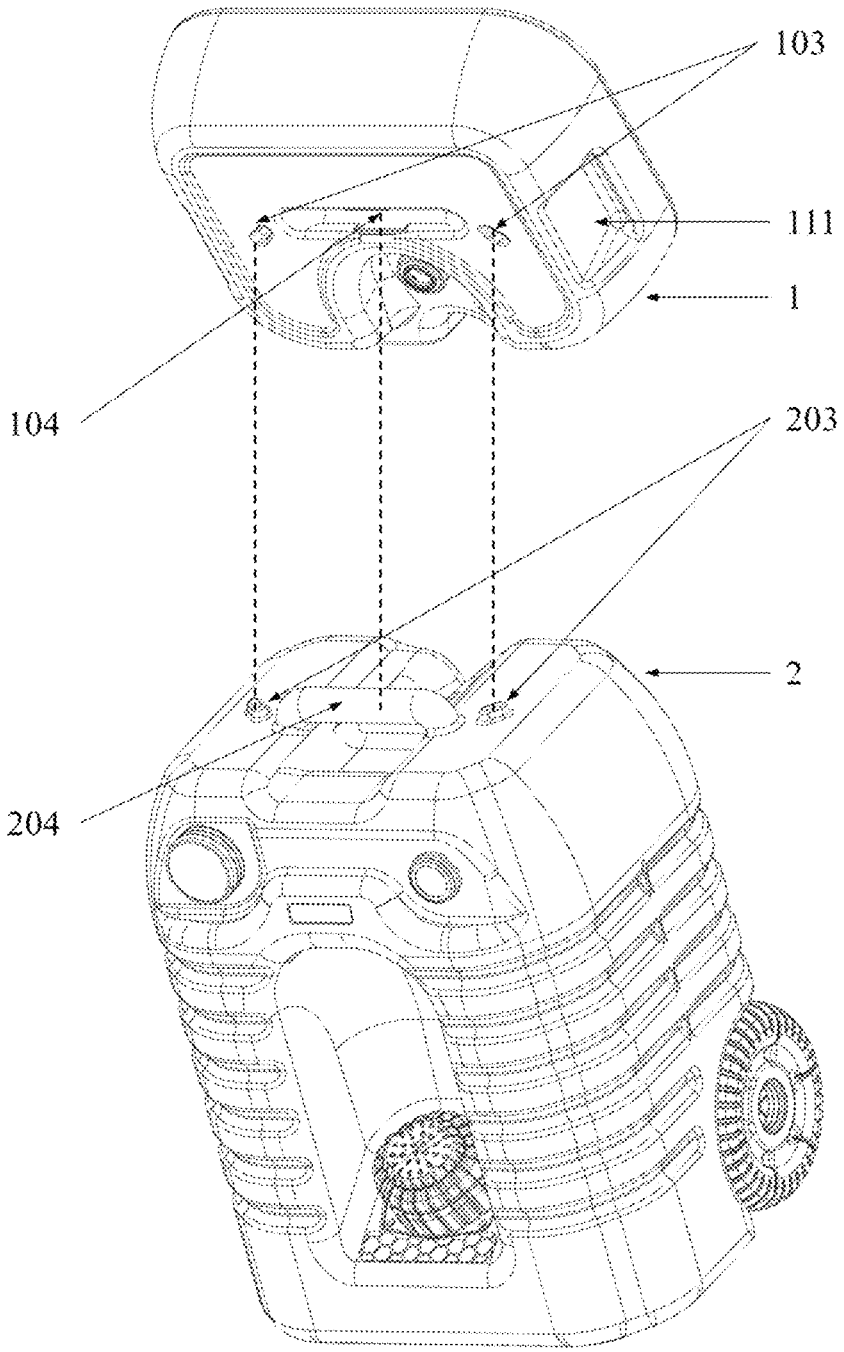
FIG. 7 is a schematic diagram of the assembly of the wash basin and a fluid storage container in an embodiment of the present application.

In some embodiments, as shown in FIG. 7, two positioning holes 103 and a positioning groove 104 are provided at a bottom of the wash basin 1, with the two positioning holes 103 respectively located on both sides of the positioning groove 104. Correspondingly, two positioning bosses 203 and a positioning frame 204 are provided at a top of the fluid storage container 2, the two positioning bosses 203 are configured to engage with respective positioning holes 103 for positioning, and the positioning frame 204 is configured to engage with and be snap-fitted into the positioning groove 104, so as to mount the wash basin on the top of the fluid storage container.

In some embodiments, the positioning frame 204 may be configured in a shape of a handle. After the wash basin 1 is removed from the top of the fluid storage container 2, the positioning frame 204 can be used to lift and move the fluid storage container 2, thereby realizing a dual role of the positioning frame 204.

In some embodiments, as shown in FIGS. 1-3, the washing station further comprises a foot-operated mechanism 5 configured to supply water to the water outlet 101. The foot-operated mechanism 5 comprises: a connecting pipe 501, a foot pump 502, and a first one-way valve 503 and a second one-way valve 504.

One end of the connecting pipe 501 is in fluid communication with an interior of the fluid storage container 2 with a sealed joint, the other end of the connecting pipe 501 is connected to the water outlet 101; the foot pump 502 is arranged at a lower part of the fluid storage container 2 and connected to the connecting pipe 501. In other words, a first end of the connecting pipe 501 is connected to the fluid storage container 2, a second end of the connecting pipe 501 is connected to the water outlet 101, and a third end of the connecting pipe 501 is connected to the foot pump 502. Optionally, the connecting pipe 501 adopts a three-way connection.

The first one-way valve 503 and the second one-way valve 504 are disposed in the connecting pipe 501. The first one-way valve is located between the fluid storage container 2 and the foot pump 502, and is configured to allow fluid to flow only from the fluid storage container 2 to the foot pump 502; the second one-way valve 504 is located between the foot pump 502 and the water outlet 101, and is configured to allow fluid to flow only from the foot pump 502 to the water outlet 101.

A one-way flow path is formed in the foot-operated mechanism 5, directing fluid from the fluid storage container 2 to the pedal pump 502, and then from the foot pump 502 to the water outlet 101, thereby preventing fluid backflow. When water is needed for washing, the foot pump 502 is stepped on, causing water in the fluid storage container 2 to be pumped into the foot pump 502 through the first one-way valve 503, and then pumped to the water outlet 101 through the second one-way valve 504 to flow out to the wash basin 1 for use.

An outer wall surface of the fluid storage container 2 facing the user when in use is defined as a front surface, while an outer wall surface opposite to the user is defined as a rear surface. As shown in FIG. 1, a first recess 205 is recessed inwardly at a lower part of the front surface, and the foot pump 502 is arranged at a bottom of the first recess 205. By accommodating the foot pump 502 in the first recess 205, space can be saved, and it facilitates foot operation by the user while preventing the foot pump 502 from protruding outward, which could otherwise result in collision or damage. As shown in FIG. 3, a second recess 206 is formed longitudinally on the rear side, and a water supply pipe 505 connecting the connecting pipe 501 to the water outlet 101 is arranged in the second recess 206.

One or more pairs of relatively protruding latch points are provided at an opening of the second recess 205, which are used to retain the water supply pipe 505 in the second recess 205 to protect the water supply pipe 505.

In some embodiments, as shown in FIG. 9, the wash basin 1 is a hollow storage container with an injection port 105 provided on a top thereof, through which fluid can be injected into the wash basin 1 for storage. For example, hand soap can be introduced into the wash basin 1 through the injection port 105 for storage, and a pressing device is mounted on the injection port 105. When washing hands with water flowing out of the water outlet 101, the user can press the pressing device to take hand soap from the wash basin 1 for washing, which is more hygienic and convenient.

Figure 8:
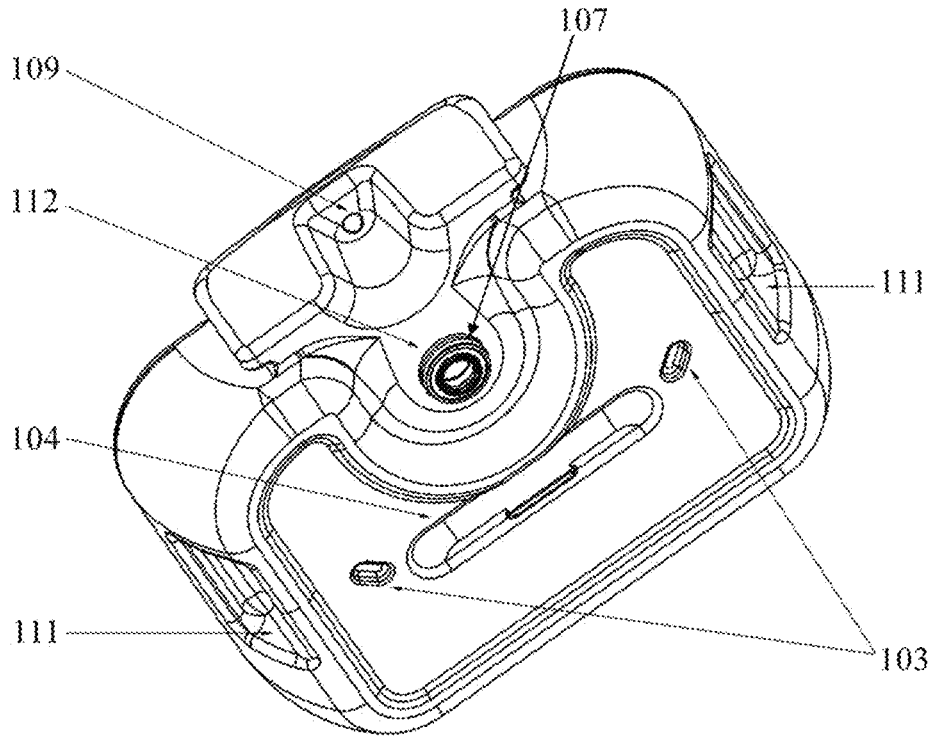
FIG. 8 is a first structural schematic diagram of the wash basin in an embodiment of the present application.

In some embodiments, referring to FIG. 8 and FIG. 9, a top surface of the wash basin 1 is recessed to form a water collection recess 106, and a drainage outlet 107 penetrating the wash basin 1 is formed at a bottom of the water collection recess 106. The water collection recess 106 facilitates temporary water retention for washing, and wastewater is discharged through the drainage outlet 107 at the bottom of the water collection recess 106. In some embodiments, a filtering element (not shown in the figures) can be provided at the drainage outlet 107, and the filtering element includes but is not limited to grating strips, filter meshes, etc.

Figure 10:
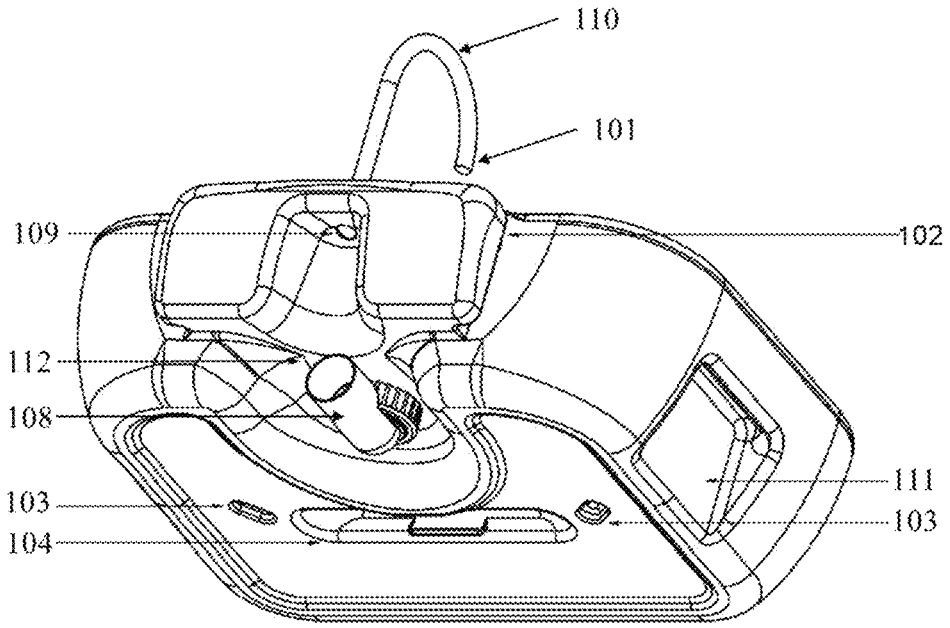
FIG. 10 is a third structural schematic diagram of the wash basin in an embodiment of the present application.

In some embodiments, threads are provided on an outer surface of the drainage outlet 107. As shown in FIG. 10, the drainage outlet 107 is threadedly connected to a drain pipe 108. One end of the drain pipe 108 is threadedly connected to the drainage outlet 107, and the other end of the drain pipe 108 is bent to discharge water out of the wash basin 1 and bypass the fluid storage container 2 below.

In some embodiments, as shown in FIGS. 8 and 10, a bottom surface of the wash basin 1 is inwardly recessed to form a drainage recess 112, the drainage outlet 107 penetrates through the bottom of the water collection recess 106 and the drainage recess 112, and the drain pipe 108 is accommodated in the drainage recess 112 to avoid the drain pipe 108 protruding from the bottom surface of the wash basin 1, so that the wash basin 1 can be placed stably on the ground for use.

In some embodiments, a through hole 109 for the water supply pipe 505 to pass through is opened in the wash basin 1 corresponding to the water supply pipe 505, and a faucet 110 is mounted above the through hole 109. The faucet 110 extends upward from the through hole 109 and bends downward to form the water outlet 101, and the water outlet 101 faces the water collection recess 106. Under the action of the foot-operated mechanism 5, the water stored in the fluid storage container 2 is pumped upward through the water supply pipe 505 to the faucet 110 and flows out from the water outlet 101 into the water collection recess 106 for the user to wash.

In some embodiments, as shown in FIGS. 8-10, a handle groove 111 is provided on each of outer walls of two opposite sides of the wash basin 1. The handle groove 111 makes it easier for users to detach the wash basin 1, preventing slipping during disassembly and making it easier to apply force when carrying the wash basin 1, thereby facilitating the movement of the wash basin 1.

As shown in FIGS. 1 and 4, a filling port 207 is provided on an upper part of the fluid storage container 2. In the present embodiment, two filling ports 207 are provided on the upper part of the fluid storage container 2. When fluid is being filled into or poured into the fluid storage container 2 through one of the filling ports 207, the other filling port 207 is used to balance the internal and external pressure of the fluid storage container 2, ensuring that the filling or pouring process can proceed smoothly.

During the use of the washing station provided in the embodiment of the present application, fluid (usually clean water) is filled into the fluid storage container 2 through the filling port 207, the pull rod 3 is rotated out of the receiving groove 202 to be positioned above the fluid storage container 2, and the pull rod 3 is pulled to cooperate with the moving device 4 to move the washing station. When washing is needed, the wash basin 1 is lifted by the handle grooves 111 to separate from the top of the fluid storage container 2. According to the user's needs, the interlocking structure 102 of the wash basin 1 is aligned and engaged with the supporting structure 301 at a required height, so that the wash basin is supported at the required height. The user can step on the foot pump 502 to press the fluid from the fluid storage container 2 to the faucet 110 for washing operations. When washing is completed, take down the wash basin 1, align the two positioning holes 103 at the bottom of the wash basin 1 with the two positioning bosses 203 at the top of the fluid storage container 2, press the wash basin 1 downward, so that the positioning frame at the top of the fluid storage container 2 is snap-fitted into the positioning groove 104 at the bottom of the wash basin 1, thereby mounting the wash basin 1 on the top of the fluid storage container 2. Then, rotate the pull rod 3 downward to place it into the second receiving groove 2022, thereby placing the washing station in its stowed position.

Finally, it is to be noted that, the embodiments are described progressively in this specification, with each embodiment focusing on the differences from the others, and the identical or similar parts among the embodiments can refer to each other.

The above embodiments are merely used for describing the technical solutions of the present application, rather than limiting the present application. Although the present application has been described in detail by preferred embodiments, it should be understood by a person of ordinary skill in the art that it is possible to make modifications to the specific implementations of the present application or equivalent replacements to some of the technical features without departing from the spirit of the technical solutions of the present application, and these modifications or equivalent replacements shall fall into the scope of the technical solutions sought to be protected by the present application.

The invention claimed is:

1. A washing station, comprising:

a fluid storage container, wherein a pull rod is provided on the fluid storage container, and a supporting structure is provided on the pull rod;

a wash basin, detachably mounted on a top of the fluid storage container, wherein at least one water outlet is provided on the wash basin, and an interlocking structure is provided on a side wall of the wash basin;

wherein the supporting structure is configured to engage with the interlocking structure to support the wash basin at different height positions;

wherein the pull rod comprises a grip portion and support portions extending in a height direction from both ends of the grip portion, at least a portion of each of the support portions serves as the supporting structure, and the supporting structure comprises a wave-shaped wavy section; and wherein the interlocking structure comprises a plurality of protrusions provided on the side wall of the wash basin, a contour of the plurality of protrusions is complementary in shape to the wavy section and configured to lockingly engage with the wavy section to provide positional constraint.

2. The washing station according to claim 1, wherein the interlocking structure is connected to the wash basin and two wing-shaped portions extending toward opposite sides are formed at an end of the interlocking structure, an interlocking slot is formed between each of the wing-shaped portions and the side wall of the wash basin, and the protrusions are formed at a closed end of each of the interlocking slots.

3. The washing station according to claim 1, wherein the pull rod further comprises two connecting portions located on a side opposite to the grip portion, and the two connecting portions extend toward each other from ends of respective support portions; mounting slots are provided on an outer wall of the fluid storage container, the connecting portions are rotatably inserted in respective mounting slots, and the pull rod is configured to rotate about the connecting portions as a rotation axis.

4. The washing station according to claim 3, wherein two receiving grooves are formed longitudinally on the outer wall of the fluid storage container, and the two receiving grooves are arranged on a same outer wall surface as the pull rod and match shapes of respective support portions; each of the mounting slots is connected with a corresponding receiving groove and is positioned near an upper part of the receiving groove, and each of the mounting slots divides the corresponding receiving groove into a first receiving groove located at an upper part and a second receiving groove located at a lower part; wherein when the pull rod is rotated upward, the support portions are received in respective first receiving grooves, and when the pull rod is rotated downward, the support portions are received in respective second receiving grooves.

5. The washing station according to claim 1, wherein two positioning holes and a positioning groove are provided at a bottom of the wash basin, with the two positioning holes respectively located on both sides of the positioning groove; two positioning bosses and a positioning frame are provided at a top of the fluid storage container; the two positioning bosses are configured to engage with respective positioning holes for positioning, and the positioning frame is configured to engage with and be snap-fitted into the positioning groove, so as to mount the wash basin on the top of the fluid storage container.

6. The washing station according to claim 5, wherein a moving device is provided at a bottom of the fluid storage container.

7. The washing station according to claim 1, further comprising a foot-operated mechanism configured to supply water to the water outlet, and the foot-operated mechanism comprises:

a connecting pipe, wherein one end of the connecting pipe is in fluid communication with an interior of the fluid storage container and another end of the connecting pipe is connected to the water outlet;

a foot pump, disposed at a lower part of the fluid storage container and connected to the connecting pipe;

a first one-way valve, disposed in the connecting pipe and located between the fluid storage container and the foot pump, wherein the first one-way valve is configured to allow fluid to flow only from the fluid storage container to the foot pump; and a second one-way valve, disposed in the connecting pipe and located between the foot pump and the water outlet, wherein the second one-way valve is configured to allow fluid to flow only from the foot pump to the water outlet.

8. The washing station according to claim 7, wherein an outer wall surface of the fluid storage container facing a user when in use is defined as a front surface, while another outer wall surface of the fluid storage container opposite to the user is defined as a rear surface; a first recess is recessed inwardly at a lower part of the front surface, and the foot pump is arranged at a bottom of the first recess; a second recess is formed longitudinally on the rear surface, and a water supply pipe connecting the connecting pipe to the water outlet is arranged in the second recess.

9. The washing station according to claim 8, wherein the wash basin is a hollow storage container and is provided with an injection port at a top of the wash basin, a top surface of the wash basin is recessed to form a water collection recess, and a drainage outlet penetrating the wash basin is formed at a bottom of the water collection recess.

10. The washing station according to claim 9, wherein a drain pipe is provided at the drainage outlet, one end of the drain pipe is connected to the drainage outlet, and another end of the drain pipe is bent to discharge water out of the wash basin and bypass the fluid storage container below.

11. The washing station according to claim 10, wherein a bottom surface of the wash basin is inwardly recessed to form a drainage recess, the drainage outlet penetrates through the bottom of the water collection recess and the drainage recess, and the drain pipe is accommodated in the drainage recess.

12. The washing station according to claim 9, wherein a through hole for the water supply pipe to pass through is opened in the wash basin corresponding to the water supply pipe, and a faucet with the water outlet facing the water collection recess is mounted above the through hole.

13. The washing station according to claim 9, wherein a handle groove is provided on each of outer walls of two opposite sides of the wash basin.

* * * * *